US008054259B2

(12) United States Patent
Kim

(10) Patent No.: US 8,054,259 B2
(45) Date of Patent: Nov. 8, 2011

(54) PIXEL AND ORGANIC LIGHT EMITTING DISPLAY DEVICE USING THE SAME

(75) Inventor: Yang-Wan Kim, Yongin (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 331 days.

(21) Appl. No.: 12/483,859

(22) Filed: Jun. 12, 2009

(65) Prior Publication Data

US 2009/0309503 A1 Dec. 17, 2009

(30) Foreign Application Priority Data

Jun. 17, 2008 (KR) ..... 10-2008-0056812

(51) Int. Cl.
*G09G 3/32* (2006.01)

(52) U.S. Cl. ..... 345/82; 345/92; 345/102; 345/204; 345/211

(58) Field of Classification Search ..... 345/82, 345/83, 92, 102, 204, 211–214
See application file for complete search history.

(56) References Cited

U.S. PATENT DOCUMENTS

| | | | | |
|---|---|---|---|---|
| 2005/0105031 | A1* | 5/2005 | Shih et al. | 349/139 |
| 2005/0206590 | A1 | 9/2005 | Sasaki et al. | |
| 2007/0115225 | A1 | 5/2007 | Uchino et al. | |
| 2009/0174699 | A1* | 7/2009 | Fish et al. | 345/214 |
| 2010/0134389 | A1* | 6/2010 | Jung et al. | 345/82 |

FOREIGN PATENT DOCUMENTS

| | | | |
|---|---|---|---|
| EP | 1 947 633 | A2 | 7/2008 |
| JP | 2005-157266 | | 6/2005 |
| KR | 10-2005-0105534 | | 11/2005 |
| KR | 1020060031547 | A | 4/2006 |
| KR | 1020070015823 | A | 2/2007 |
| KR | 100833760 | B1 | 5/2008 |
| KR | 1020080067489 | A | 7/2008 |

OTHER PUBLICATIONS

Chinese Office action dated May 26, 2010 of the Chinese Patent Application No. 200910142449.0, which claims priority of the corresponding Korean Priority Application No. 10-2008-0056812, 10 pages.

Korean Office action dated Sep. 29, 2009, for corresponding Korean Patent Application No. 10-2008-0056812.

KIPO Office action dated Dec. 29, 2009 for the corresponding Korean Priority Application No. 10-2008-0056812.

European Search Report dated Aug. 25, 2009, for corresponding European application 09162891.7.

* cited by examiner

*Primary Examiner* — Tuyet Thi Vo
(74) *Attorney, Agent, or Firm* — Christie, Parker & Hale, LLP

(57) ABSTRACT

A pixel for compensating for the threshold voltage of a drive transistor and the voltage drop of a first power source is provided. The pixel includes an organic light emitting diode; a driving transistor coupled between a first power source and the organic light emitting diode for controlling the current supplied to the organic light emitting diode; an emission control transistor coupled between a first electrode of the driving transistor and the first power source and configured to be turned off when a high light emission control signal is applied; a switching transistor coupled between a gate electrode of the driving transistor and a data line and configured to be turned on when a low scan signal is applied; a first capacitor coupled between the gate electrode of the driving transistor and the first electrode of the driving transistor; and a second capacitor coupled between the first electrode of the driving transistor and the first power source.

11 Claims, 4 Drawing Sheets

PIXEL AND ORGANIC LIGHT EMITTING DISPLAY DEVICE USING THE SAME

CROSS-REFERENCE TO RELATED APPLICATION

This application claims priority to and the benefit of Korean Patent Application No. 10-2008-0056812, filed on Jun. 17, 2008, in the Korean Intellectual Property Office, the entire content of which is incorporated herein by reference.

BACKGROUND

1. Field of the Invention

The present invention relates to a pixel and an organic light emitting display device using the same.

2. Discussion of Related Art

In recent years, various flat panel display devices have been developed with reduced weight and volume as compared to cathode ray tubes. Types of flat panel display devices include liquid crystal display devices, field emission display devices, plasma display devices, and organic light emitting display devices, among others.

Of these flat panel display devices, the organic light emitting display device displays an image by using organic light emitting diodes, which generate light by recombining electrons and holes. Organic light emitting display devices are advantageous in that they have rapid response times and may be driven with relatively low power consumption.

FIG. 1 is a circuit illustrating a pixel of a conventional organic light emitting display device.

Referring to FIG. 1, the pixel 4 of the conventional organic light emitting display device includes an organic light emitting diode (OLED), and a pixel circuit 2 coupled to a data line (Dm) and a scan line (Sn) to control the organic light emitting diode (OLED).

An anode electrode of the organic light emitting diode (OLED) is coupled to the pixel circuit 2, and a cathode electrode of the organic light emitting diode (OLED) is coupled to a second power source (ELVSS). The organic light emitting diode (OLED) generates light with a luminance corresponding to an electric current supplied from the pixel circuit 2.

The pixel circuit 2 controls an amount of current supplied to the organic light emitting diode (OLED) in accordance with a data signal supplied to the data line (Dm) when a scan signal is supplied to the scan line (Sn). For this purpose, the pixel circuit 2 includes a second transistor (M2') (e.g., a driving transistor) coupled between a first power source (ELVDD) and the organic light emitting diode (OLED); a first transistor (M1') (e.g., a switching transistor) coupled between the gate electrode of the second transistor (M2') and the data line (Dm), and having a gate electrode coupled to the scan line (Sn); and a storage capacitor (Cst) coupled between a gate electrode and a first electrode of the second transistor (M2').

A gate electrode of the first transistor (M1') is coupled to the scan line (Sn), and a first electrode of the first transistor (M1') is coupled to the data line (Dm). A second electrode of the first transistor (M1') is coupled to one terminal of the storage capacitor (Cst). Here, the first electrode of the first transistor (M1') is either a source electrode or a drain electrode, and the second electrode of the first transistor (M1') is the other of the source electrode and the drain electrode. For example, when the first electrode is the source electrode, the second electrode is the drain electrode. The first transistor (M1') is turned on when a scan signal is supplied from the scan line (Sn), and supplies a data signal from the data line (Dm) to the storage capacitor (Cst). In this case, the storage capacitor (Cst) is charged with a voltage corresponding to the data signal.

A gate electrode of the second transistor (M2') is coupled to one terminal of the storage capacitor (Cst), and a first electrode of the second transistor (M2') is coupled to the other terminal of the storage capacitor (Cst) and the first power source (ELVDD). A second electrode of the second transistor (M2') is coupled to an anode electrode of the organic light emitting diode (OLED). The second transistor (M2') controls the amount of current in accordance with a voltage value stored in the storage capacitor (Cst), the current flowing from the first power source (ELVDD) to the second power source (ELVSS) via the organic light emitting diode (OLED). In this case, the organic light emitting diode (OLED) generates light in accordance with the amount of current supplied from the second transistor (M2').

However, the pixel 4 of the conventional organic light emitting display device has difficulties displaying images with uniform luminance. More particularly, a threshold voltage of the second transistor (M2') in each of the plurality of the pixels 4 may have different threshold voltage levels due to manufacturing process variances. When the threshold voltages of the drive transistors have different threshold voltage levels as described above, different luminances may be generated in the organic light emitting diodes (OLEDs), even though data signals corresponding to a same gray level are supplied to the plurality of the pixels 4.

Also, in a conventional organic light emitting display device, a voltage from the first power source (ELVDD) may be inconsistently applied due to voltage drops of the voltage from the first power source (ELVDD), depending on the positions of the pixels 4 in the display device. When the voltage from the first power source (ELVDD) varies according to the positions of the pixels 4 as described above, it is very difficult to display an image with a uniform or desired luminance.

SUMMARY OF THE INVENTION

Accordingly, an aspect of an embodiment according to the present invention is to provide a pixel capable of compensating for the threshold voltage of a driving transistor and the voltage drop of a first power source, and an organic light emitting display device using the same.

One aspect of an embodiment according to the present invention provides a pixel including: an organic light emitting diode; a second transistor coupled between a first power source and the organic light emitting diode, the second transistor for controlling an amount of current supplied from the first power source to the organic light emitting diode; a third transistor coupled between a first electrode of the second transistor and the first power source, the third transistor configured to turn off when a light emission control signal is applied to a light emission control line coupled to a gate electrode of the third transistor; a first transistor coupled between a gate electrode of the second transistor and a data line, the first transistor configured to turn on when a scan signal is applied to a scan line coupled to a gate electrode of the first transistor; a first capacitor coupled between the gate electrode of the second transistor and the first electrode of the second transistor; and a second capacitor coupled between the first electrode of the second transistor and the first power source.

In this case, the second capacitor may have a greater capacitance than the first capacitor. Also, the second capacitor may have a capacitance 2 to 10 times a capacitance of the first capacitor.

Another aspect of an embodiment according to the present invention provides an organic light emitting display device including: a scan driver for applying scan signals to a plurality of scan lines and for applying light emission control signals to a plurality of light emission control lines; a data driver for supplying a reset power voltage and for applying data signals to a plurality of data lines; and a plurality of pixels arranged at crossing regions of the plurality of data lines and the plurality of scan lines, wherein each of the plurality of pixels includes: an organic light emitting diode; a second transistor coupled between a first power source and the organic light emitting diode, the second transistor for controlling an amount of current supplied from the first power source to the organic light emitting diode; a third transistor coupled between a first electrode of the second transistor and the first power source, the third transistor configured to turn off when a light emission control signal is applied to a light emission control line coupled to a gate electrode of the third transistor; a first transistor coupled between a gate electrode of the second transistor and a data line, the first transistor configured to turn on when a scan signal is applied to a scan line coupled to a gate electrode of the first transistor; a first capacitor coupled between the gate electrode of the second transistor and the first electrode of the second transistor; and a second capacitor coupled between the first electrode of the second transistor and the first power source.

In this case, the scan driver may be configured to apply a light emission control signal to an $i^{th}$ light emission control line during a second portion and a third portion of a period in which a scan signal is being applied to a corresponding $i^{th}$ scan line. Here, the scan driver may be configured to stop the application of the light emission control signal after the application of the scan signal is stopped. Also, the data driver may be configured to supply the reset power voltage to the data lines during a first portion and the second portion of the period, and wherein the data driver is configured to apply the data signal during the third portion of the period. In addition, the reset power voltage may be higher than the data signal. Furthermore, the reset power voltage may be lower than a voltage of the first power source.

As described above, a pixel according to aspects of embodiments of the present invention and an organic light emitting display device using the same may be useful to display an image with uniform luminance by compensating for the threshold voltage of the driving transistor and the voltage drop of the first power source.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
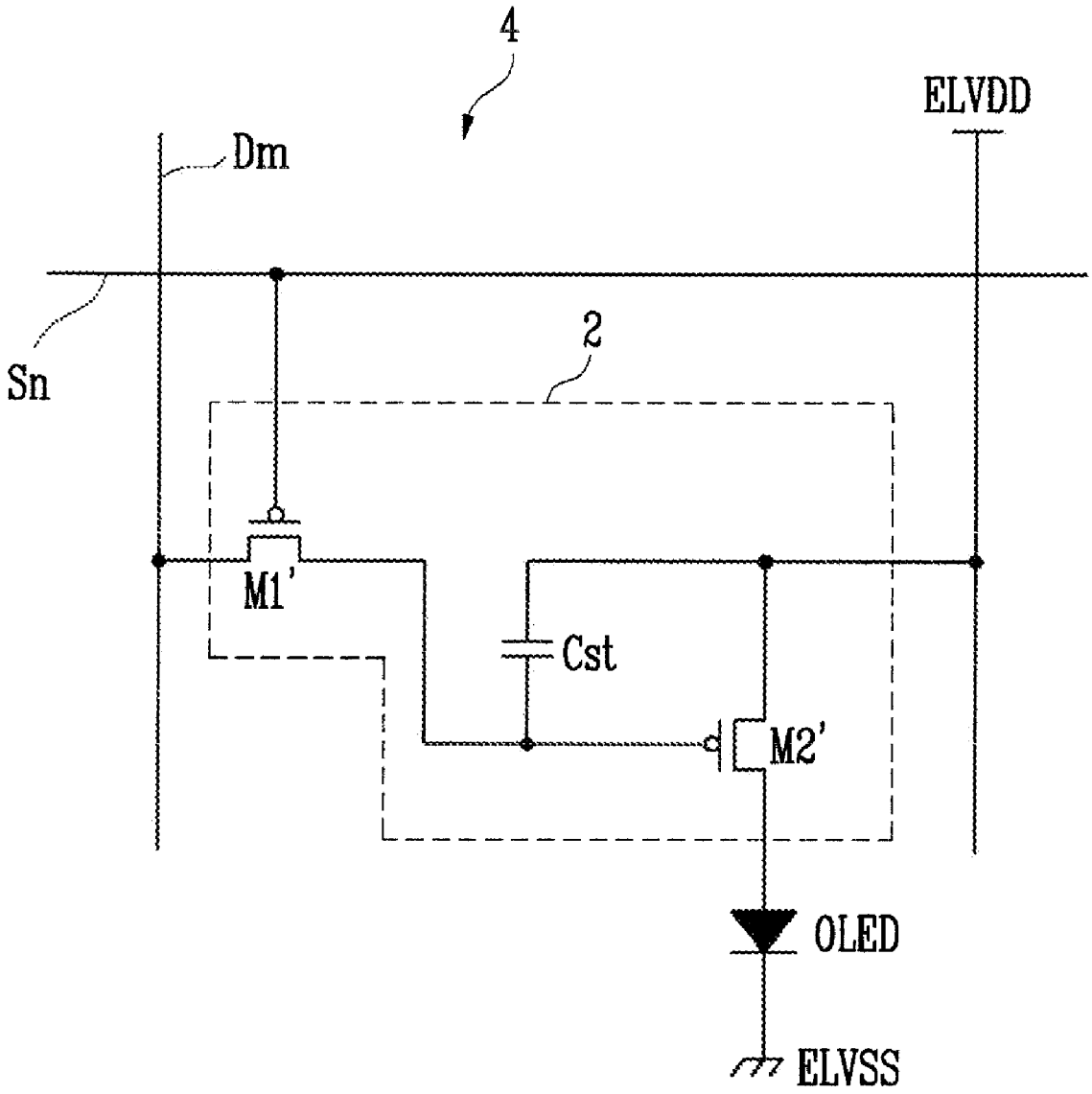
FIG. 1 (PRIOR ART)
FIG. 1 is a circuit illustrating a conventional pixel.

Hereinafter, certain exemplary embodiments according to the present invention will be described with reference to the accompanying drawings. Here, when a first element is described as being coupled to a second element, the first element may be directly coupled to the second element or may be indirectly coupled to the second element via one or more additional elements. Further, some of the elements that are not essential to the complete understanding of the invention are omitted for clarity. Also, like reference numerals refer to like elements throughout.

Figure 2:
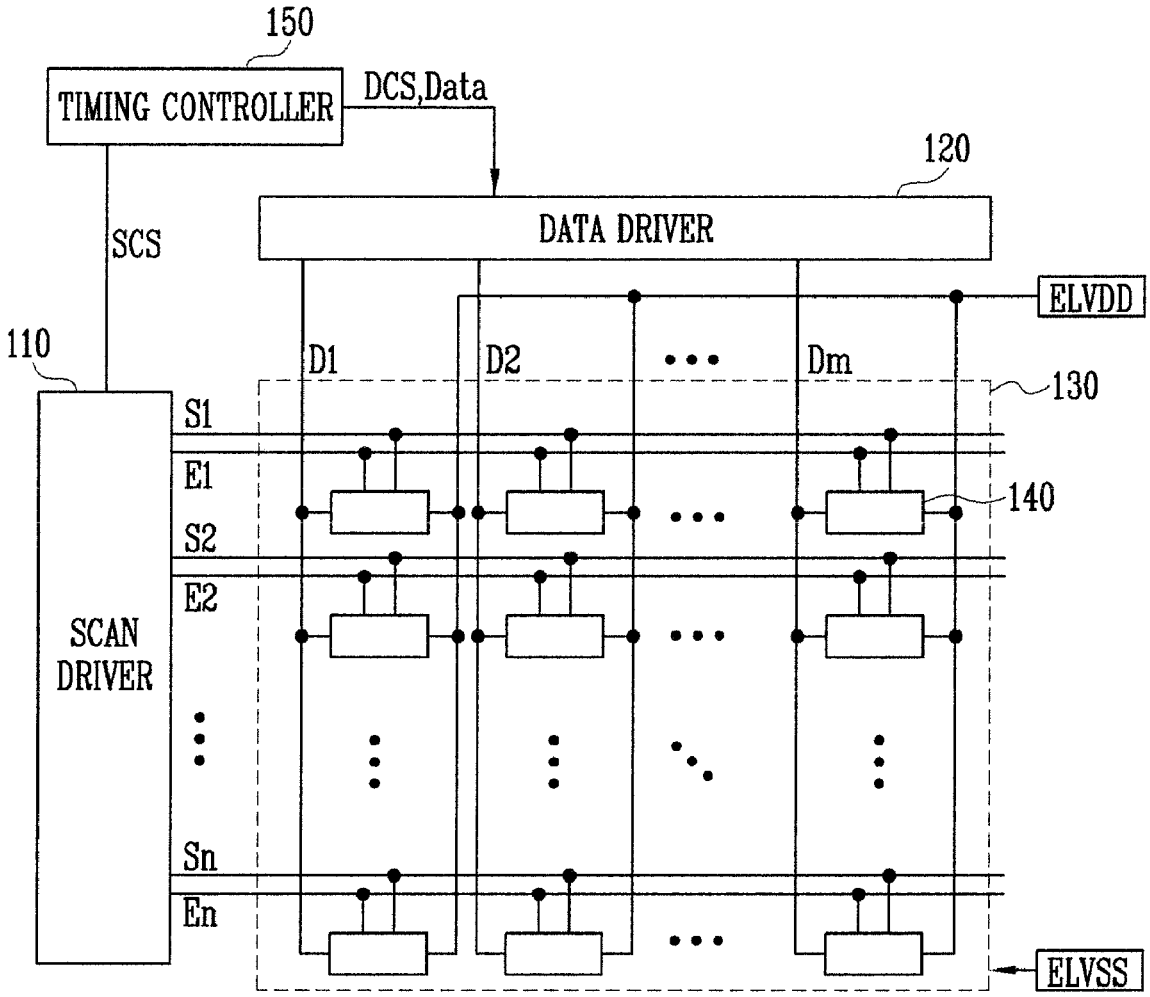
FIG. 2 is a schematic block diagram illustrating an organic light emitting display device according to one exemplary embodiment of the present invention.

FIG. 2 is a schematic block diagram illustrating an organic light emitting display device according to one exemplary embodiment of the present invention.

Referring to FIG. 2, the organic light emitting display device according to one exemplary embodiment of the present invention includes a display unit 130 including pixels 140 arranged at crossing regions of scan lines (S1 to Sn) and data lines (D1 to Dm); a scan driver 110 driving the scan lines (S1 to Sn) and light emission control lines (E1 to En); a data driver 120 driving the data lines (D1 to Dm); and a timing controller 150 controlling the scan driver 110 and the data driver 120.

Figure 3:
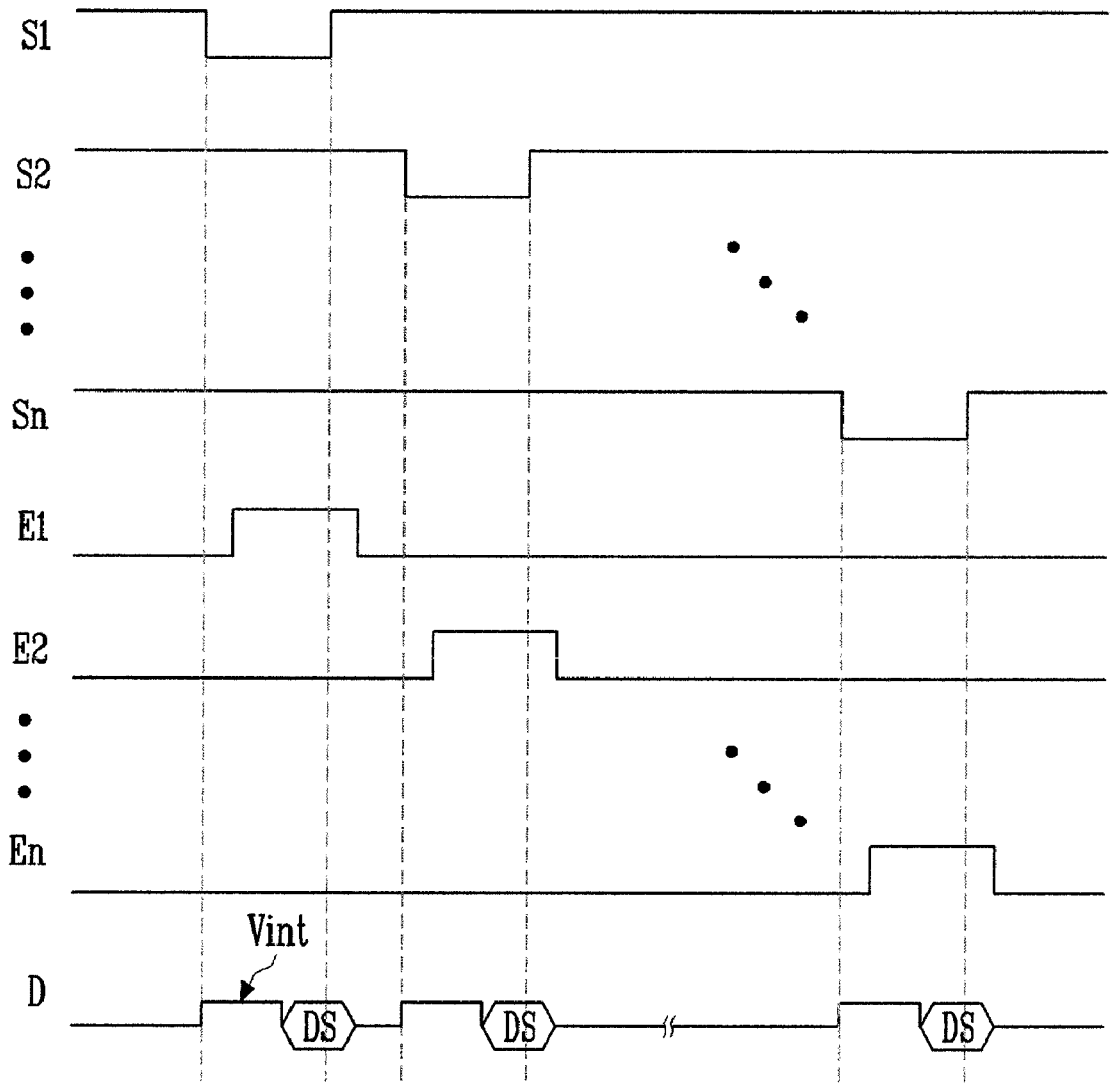
FIG. 3 is a waveform illustrating a driving waveform supplied from a scan driver and a data driver as shown in FIG. 2.

The scan driver 110 receives a scan drive control signal (SCS) from the timing controller 150, and sequentially supplies a scan signal to the scan lines (S1 to Sn), as shown in FIG. 3. Also, the scan driver 110 sequentially supplies a light emission control signal to the light emission control lines (E1 to En). Here, the light emission control signal supplied to an $i^{th}$ light emission control line (Ei) is turned on after a corresponding scan signal to the $i^{th}$ scan line (Si) is turned on, and turned off after the corresponding scan signal to the $i^{th}$ scan line (Si) is turned off. In this embodiment, a scan signal has a LOW level voltage when it is applied, and a light emission control signal has a HIGH level voltage when it is applied. In other embodiments, the scan signal and the emission control signal may be at either high or low levels when they are applied, depending on the particular embodiment, without being limited to any particular embodiment.

The data driver 120 receives a data drive control signal (DCS) and, in some embodiments, additional data (Data) from the timing controller 150. The data driver 120 generates a data signal (DS), and supplies the generated data signal (DS) to the data lines (D1 to Dm). Here, the data driver 120 supplies a reset power source (Vint) (e.g., the reset power source (Vint) described with respect to FIG. 3) to the data lines (D1 to Dm) during a portion of a period when the scan signal is on. The data driver 120 supplies a data signal (DS) to the data lines (D1 to Dm) during a remaining portion of the period when the scan signal is on. A voltage of the reset power source (Vint) is set to a higher voltage level than that of the data signal (DS), and set to a lower voltage level than that of the first power source (ELVDD).

The timing controller 150 generates a data drive control signal (DCS) and a scan drive control signal (SCS) in accordance with external synchronization signals. The data drive control signal (DCS) generated in the timing controller 150 is supplied to the data driver 120, and the scan drive control signal (SCS) is supplied to the scan driver 110. The timing controller 150 may also supply external data (Data) to the data driver 120.

The display unit 130 receives a first power source (ELVDD) and a second power source (ELVSS) from the outside, and supplies the first power source (ELVDD) and second power source (ELVSS) to each of the pixels 140. Each of the pixels 140 generates light corresponding to the data signal (DS).

Figure 4:
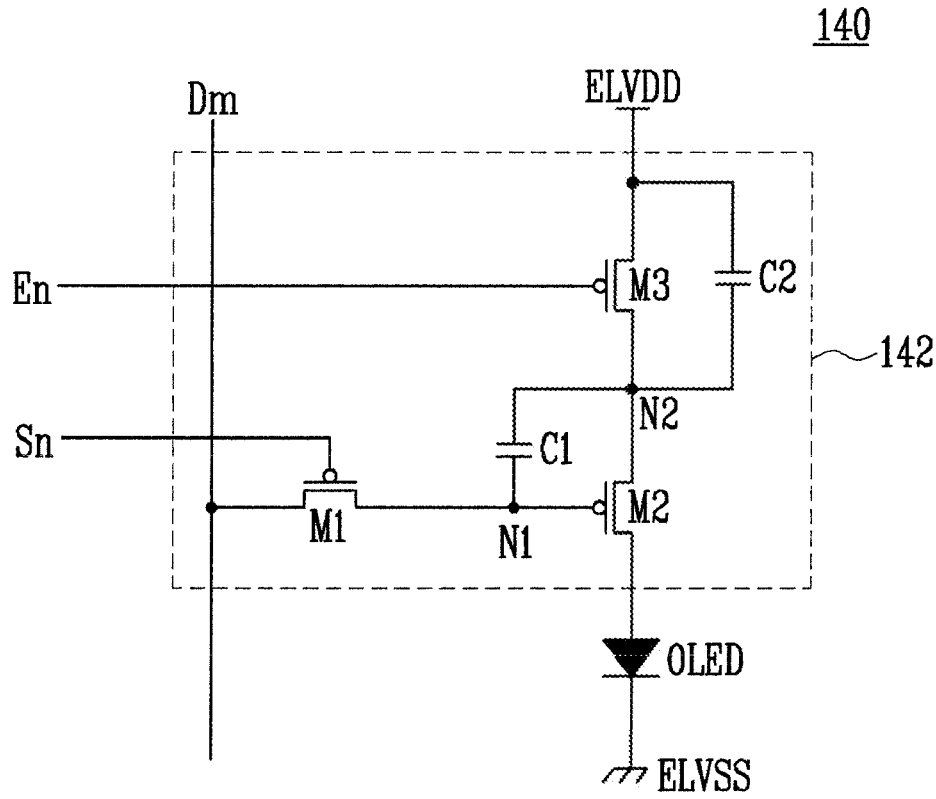
FIG. 4 is a circuit illustrating a pixel according to one exemplary embodiment of the present invention as shown in FIG. 2.

FIG. 4 is a diagram illustrating a pixel according to one exemplary embodiment of the present invention, for example, the embodiment illustrated in FIG. 2. For convenience, FIG. 4 shows a pixel coupled to an $n^{th}$ scan line (Sn) and an $m^{th}$ data line (Dm).

Referring to FIG. 4, the pixel 140 according to one exemplary embodiment of the present invention includes an organic light emitting diode (OLED); and a pixel circuit 142 coupled to the data line (Dm) and the scan line (Sn) to control the current supplied to the organic light emitting diode (OLED).

An anode electrode of the organic light emitting diode (OLED) is coupled to the pixel circuit 142, and a cathode electrode of the organic light emitting diode (OLED) is coupled to a second power source (ELVSS). The organic light emitting diode (OLED) generates light with a luminance in accordance with the amount of current supplied from the pixel circuit 142. Here, a voltage of the second power source (ELVSS) is set to a lower voltage level than that of the first power source (ELVDD).

The pixel circuit 142 controls the amount of current supplied to the organic light emitting diode (OLED) by utilizing the data signal supplied to the data line (Dm) in accordance with a scan signal supplied to the scan line (Sn). For this purpose, the pixel circuit 142 includes first, second, and third transistors (M1, M2, and M3), a first capacitor (C1) and a second capacitor (C2).

A first electrode of the first transistor (M1) (e.g., a switching transistor) is coupled to the data line (Dm), and a second electrode of the first transistor (M1) is coupled to a first node (N1), which is also coupled to a gate electrode of the second transistor (M2) (e.g., a driving transistor). A gate electrode of the first transistor (M1) is coupled to the scan line (Sn). The first transistor (M1) is turned on in accordance with a scan signal supplied to the scan line (Sn), and supplies a reset power source or a data signal from the data line (Dm) to the first node (N1).

A first electrode of the second transistor (M2) is coupled to a second node (N2), which is also coupled to a second electrode of the third transistor (M3) (e.g., an emission control transistor), and a second electrode of the second transistor (M2) is coupled to an anode electrode of the organic light emitting diode (OLED). A gate electrode of the second transistor (M2) is coupled to the first node (N1). The second transistor (M2) applies an electric current to the organic light emitting diode (OLED), the electric current corresponding to the voltage applied to the first node (N1).

A first electrode of the third transistor (M3) is coupled to the first power source (ELVDD), and the second electrode of the third transistor (M3) is coupled to the second node (N2). A gate electrode of the third transistor (M3) is coupled to the light emission control line (En). The third transistor (M3) is turned off when a high light emission control signal is supplied to the light emission control line (En), and turned on when a low light emission control signal is supplied to the light emission control line (En).

The first capacitor (C1) is coupled between the first node (N1) and the second node (N2). The first capacitor (C1) stores a voltage corresponding to the data signal and the threshold voltage of the second transistor (M2).

The second capacitor (C2) is arranged between the first power source (ELVDD) and the second node (N2). The second capacitor (C2) stably maintains a voltage of the second node (N2). For this purpose, the second capacitor (C2) has a greater capacitance than the first capacitor (C1). For example, the second capacitor (C2) may have a capacitance 2 to 10 times the capacitance of the first capacitor (C1), or more.

Figure 5:
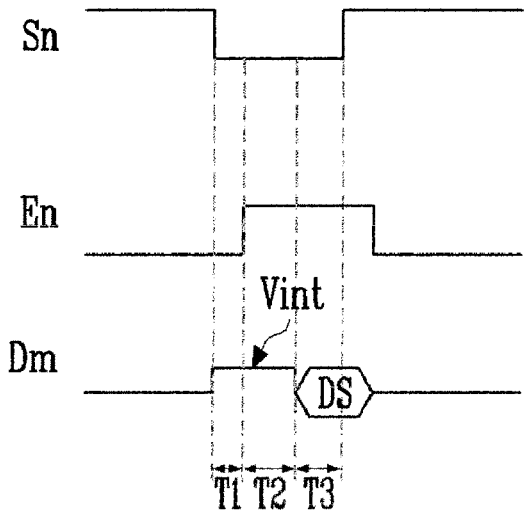
FIG. 5 is a waveform illustrating a driving waveform of the pixel as shown in FIG. 4.

An operation of the pixel 140 will be described in detail in connection with a waveform as shown in FIG. 5. First, when a low scan signal is supplied to the scan line (Sn), the first transistor (M1) is turned on. A reset power source (Vint) is supplied to the data line (Dm) during a first portion (T1) of a period when the low scan signal is supplied to the scan line (Sn).

During the first portion (T1), the reset power source (Vint) is supplied to the first node (N1) via the first transistor (M1). Since the third transistor (M3) is turned on during the first portion (T1), the second node (N2) maintains a voltage of the first power source (ELVDD). The second transistor (M2) is turned on since the reset power source (Vint) is set to a lower voltage value than the first power source (ELVDD).

During a second portion (T2) of the period when the low scan signal is supplied to the scan line (Sn), the third transistor (M3) is turned off since a high light emission control signal is supplied to the light emission control line (En). When the third transistor (M3) is turned off, the second transistor (M2) is consequently turned off. When the second transistor (M2) is turned off, a voltage corresponding to the threshold voltage of the second transistor (M2) (e.g., a voltage difference between the second node (N2) and the first node (N1)) is charged in the first capacitor (C1) during the second portion (T2) of the period.

During a third portion (T3) of the period when the scan signal is supplied to the scan line (Sn), a data signal (DS) is supplied to the data line (Dm). During the third portion (T3), the data signal (DS) supplied to the data line (Dm) is supplied to the first node (N1) via the first transistor (M1). When the data signal (DS) is supplied to the first node (N1), the voltage of the first node (N1) drops from the reset power source (Vint) to the voltage of the data signal (DS). In this case, the second node (N2) maintains an applied voltage during the third portion (T3) of the period. More particularly, the second capacitor (C2) has a greater capacitance than the first capacitor (C1). Therefore, the voltage at the second node (N2) may be maintained during the third portion (T3), even though the voltage at the first node (N1) is changed. Thus, a voltage corresponding to the data signal adjusted by the threshold voltage of the second transistor (M2) is charged in the first capacitor (C1).

Then, the first transistor (M1) is turned off when the scan signal supplied to the scan line (Sn) is turned high. When the first transistor (M1) is turned off, the first node (N1) is floated. Then, when the supply of the light emission control signal to the light emission control line (En) is turned low, the third transistor (M3) is turned on. When the third transistor (M3) is turned on, the second transistor (M2) supplies an electric current to the organic light emitting diode (OLED) in accordance with the voltage applied to the first node (N1).

When the third transistor (M3) is turned on, a voltage of the first power source (ELVDD) is supplied to the second node (N2). In this case, the voltage of the floating first node (N1) is also increased to correspond with the increase in the voltage of the second node (N2). In other words, the voltage charged in the first capacitor (C1) is maintained when the third transistor (M3) is turned on.

Also, since the first node (N1) is floating when the voltage from the first power source (ELVDD) is supplied to the second node (N2), voltage variances of the voltage from the first power source (ELVDD) due to the position at which the pixels 140 are located may be compensated for. In other words, the voltage of the first node (N1) is increased corresponding to the increase in the voltage of the second node (N2), and therefore it is possible to display an image with a desired luminance regardless of the voltage drop of the voltage from the first power source (ELVDD).

While the present invention has been described with respect to certain exemplary embodiments, it is to be understood that the invention is not limited to the disclosed embodiments, but instead is intended to cover various modifications and equivalent arrangements included within the spirit and scope of the appended claims and equivalents thereof.

What is claimed is:

1. A pixel, comprising:

an organic light emitting diode;

a second transistor coupled between a first power source and the organic light emitting diode, the second transistor for controlling an amount of current supplied from the first power source to the organic light emitting diode;

a third transistor coupled between a first electrode of the second transistor and the first power source, the third transistor configured to turn off when a light emission control signal is applied to a light emission control line coupled to a gate electrode of the third transistor;

a first transistor coupled between a gate electrode of the second transistor and a data line, the first transistor configured to turn on when a scan signal is applied to a scan line coupled to a gate electrode of the first transistor;

a first capacitor coupled between the gate electrode of the second transistor and the first electrode of the second transistor; and a second capacitor coupled between the first electrode of the second transistor and the first power source.

2. The pixel according to claim 1, wherein the second capacitor has a greater capacitance than the first capacitor.

3. The pixel according to claim 2, wherein the second capacitor has a capacitance 2 to 10 times a capacitance of the first capacitor.

4. An organic light emitting display device, comprising:

a scan driver for applying scan signals to a plurality of scan lines and for applying light emission control signals to a plurality of light emission control lines;

a data driver for supplying a reset power voltage and for applying data signals to a plurality of data lines; and a plurality of pixels arranged at crossing regions of the plurality of data lines and the plurality of scan lines, each of the plurality of pixels comprising:

an organic light emitting diode;

a second transistor coupled between a first power source and the organic light emitting diode, the second transistor for controlling an amount of current supplied from the first power source to the organic light emitting diode;

a third transistor coupled between a first electrode of the second transistor and the first power source, the third transistor configured to turn off when a light emission control signal of the light emission control signals is applied to a light emission control line coupled to a gate electrode of the third transistor from among the plurality of light emission control lines;

a first transistor coupled between a gate electrode of the second transistor and a data line from among the plurality of data lines, the first transistor configured to turn on when a scan signal of the scan signals is applied to a scan line coupled to a gate electrode of the first transistor from among the plurality of scan lines;

a first capacitor coupled between the gate electrode of the second transistor and the first electrode of the second transistor; and a second capacitor coupled between the first electrode of the second transistor and the first power source.

5. The organic light emitting display device according to claim 4, wherein the second capacitor has a greater capacitance than the first capacitor.

6. The organic light emitting display device according to claim 5, wherein the second capacitor has a capacitance 2 to 10 times a capacitance of the first capacitor.

7. The organic light emitting display device according to claim 4, wherein the scan driver is configured to apply a light emission control signal of the light emission control signals to an $i^{th}$ light emission control line from among the plurality of light emission control lines during a second portion and a third portion of a period in which a scan signal of the scan signals is being applied to a corresponding $i^{th}$ scan line from among the plurality of scan lines.

8. The organic light emitting display device according to claim 7, wherein the scan driver is configured to stop the application of the light emission control signal after the application of the scan signal is stopped.

9. The organic light emitting display device according to claim 7, wherein the data driver is configured to supply the reset power voltage to the data lines during a first portion and the second portion of the period, and wherein the data driver is configured to apply the data signals during the third portion of the period.

10. The organic light emitting display device according to claim 4, wherein the reset power voltage is higher than the data signals.

11. The organic light emitting display device according to claim 10, wherein the reset power voltage is lower than a voltage of the first power source.

* * * * *